US007974545B2

(12) United States Patent
Hamada et al.

(10) Patent No.: US 7,974,545 B2
(45) Date of Patent: Jul. 5, 2011

(54) DEVELOPING DEVICE AND IMAGE FORMING APPARATUS THAT UTILIZE A VARIABLE AC BIAS VOLTAGE

(75) Inventors: Toshimasa Hamada, Kashihara (JP); Nobuhiro Maezawa, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 211 days.

(21) Appl. No.: 12/393,388

(22) Filed: Feb. 26, 2009

(65) Prior Publication Data

US 2009/0214240 A1 Aug. 27, 2009

(30) Foreign Application Priority Data

Feb. 27, 2008 (JP) ..... P2008-046918

(51) Int. Cl.
*G03G 15/06* (2006.01)

(52) U.S. Cl. ..... 399/55; 399/53; 399/285

(58) Field of Classification Search ..... 399/53, 399/55, 285
See application file for complete search history.

(56) References Cited

U.S. PATENT DOCUMENTS 4,473,627 A * 9/1984 Kanbe et al. ..... 399/314
5,999,782 A 12/1999 Iguchi et al.
6,282,385 B1 * 8/2001 Suto ..... 399/55
2005/0196189 A1 9/2005 Matsuura et al.
2009/0304414 A1 * 12/2009 Hamada ..... 399/270
2009/0317143 A1 * 12/2009 Hamada ..... 399/270

FOREIGN PATENT DOCUMENTS

JP 02-25856 1/1990
JP 5-297691 A 11/1993
JP 11-44985 A 2/1999
JP 2000-227701 8/2000
JP 2000-347507 12/2000
JP 2005-250125 A 9/2005

OTHER PUBLICATIONS

English Translation JP05-297691 to Takahashi et al.*

* cited by examiner

*Primary Examiner* — Ryan D Walsh
(74) *Attorney, Agent, or Firm* — Nixon & Vanderhye, PC

(57) ABSTRACT

A developing device capable of improving the image density and the dot reproducibility, and an image forming apparatus including the same are provided. A developing device applies an alternating voltage superimposed on a direct current voltage to a developing roller to thereby develop an electrostatic latent image formed on a photoreceptor with toner. A bias voltage waveform superimposed at this time has an original period (first period) in which each of a development-side electrical potential and an opposite development-side electrical potential is applied one time and a period (second period) in which a Vpp is gradually increased from the initial value to the maximum value.

14 Claims, 16 Drawing Sheets

FIG. 10

| FREQUENCY | TONER FOGGING | DENSITY |
|---|---|---|
| 2kHz | POOR | GOOD |
| 5kHz | AVAILABLE | GOOD |
| 8kHz | GOOD | GOOD |
| 10kHz | GOOD | GOOD |
| 15kHz | GOOD | GOOD |
| 20kHz | GOOD | GOOD |
| 25kHz | GOOD | AVAILABLE |
| 30kHz | GOOD | POOR |

FIG. 11

| FREQUENCY | DOT REPRODUCIBILITY | TONER FOGGING |
|---|---|---|
| 3 | POOR | GOOD |
| 4 | GOOD | GOOD |
| 5 | GOOD | GOOD |
| 8 | GOOD | GOOD |
| 15 | GOOD | AVAILABLE |
| 20 | POOR | POOR |

FIG. 14

| DUTY RATIO | DENSITY | DOT REPRODUCIBILITY |
|---|---|---|
| 0.15 | POOR | EXCELLENT |
| 0.25 | AVAILABLE | EXCELLENT |
| 0.35 | GOOD | EXCELLENT |
| 0.45 | GOOD | EXCELLENT |
| 0.5 | GOOD | GOOD |
| 0.6 | AVAILABLE | POOR |
| 0.7 | POOR | POOR |

DEVELOPING DEVICE AND IMAGE FORMING APPARATUS THAT UTILIZE A VARIABLE AC BIAS VOLTAGE

CROSS-REFERENCE TO RELATED APPLICATION

This application claims priority to Japanese Patent Application No. 2008-046918, which was filed on Feb. 27, 2008, the contents of which are incorporated herein by reference in its entirety.

BACKGROUND OF THE INVENTION

1. Field of the Invention

The present invention relates to a developing device for applying an alternating voltage superimposed on a direct current voltage to a developer bearing member to thereby develop an electrostatic latent image formed on an electrostatic latent image bearing member with toner, and an image forming apparatus including the same.

2. Description of the Related Art

In an electrophotographic image forming apparatus, a development method has been employed in which the surface of an electrostatic latent image bearing member (for example, a photoreceptor) is charged and an image is exposed to the charged region to from an electrostatic latent image, and the electrostatic latent image is developed so as to be made visible (developing).

As the development method, a development method has been commonly used in which, using one-component developer containing toner or two-component developer containing carrier and toner, by frictionally charging the toner so that the toner is attracted with an electrostatic force of an electrostatic latent image on the surface of the electrostatic latent image bearing member, the electrostatic latent image is developed to thereby form a toner image.

For example, when two-component developer is used, a method has been employed, in which a magnetic brush by carrier is formed on a developer bearing member (for example, a developing roller) in a developing device, and an electrostatic latent image is developed while applying a bias voltage between the developer bearing member and an electrostatic latent image bearing member.

Moreover, whether one-component or two-component developer is used, there is a case where development is performed using toner that is charged with a polarity opposite to a surface potential of the charged electrostatic latent image bearing member, or a case where reversal development is performed using toner that is charged with a polarity the same as the surface potential of the charged electrostatic latent image bearing member.

In addition, there is also a case where an electrostatic latent image that is formed on the electrostatic latent image bearing member is developed with the toner by applying an oscillating bias voltage between the developer bearing member and the electrostatic latent image bearing member. In this oscillating bias voltage, a development-side electrical potential that can apply a force to the charged toner in the direction from the developer bearing member toward the electrostatic latent image bearing member and an opposite development-side electrical potential that can apply a force to the toner in the direction from the electrostatic latent image bearing member to the developer bearing member alternate with each other, and for example, a rectangular wave is commonly used whose ratio (duty ratio) of the application time during which the development-side electrical potential is applied to the application time of a cycle during which the development-side electrical potential and the opposite development-side electrical potential are applied is 50%.

Incidentally, in such a conventional development method, it is desirable that the charge amount of the toner is increased to obtain smooth image quality with little roughness. However, for example, when two-component developer is used, the electrostatic force between carrier and toner is in proportion to the square of the charge amount, thus, when the charge amount of the toner is increased, a rate that development is performed with the carrier separated from the toner decreases. Accordingly, the utilization efficiency of the toner consequently deteriorates and the image density is reduced.

In order to increase the image density, an oscillation amplitude voltage Vpp (peak-to-peak voltage) of the oscillating bias voltage may be increased. However, when the Vpp is increased, an electric field in the direction where the toner returns from the electrostatic latent image bearing member to the developer bearing member is strengthened, thus a toner image that has been attached to the electrostatic latent image bearing member once is peeled off and dot is not added completely. That is, so-called dot reproducibility tends to deteriorate.

As a developing device that achieves both improved image density and dot reproducibility, Japanese Unexamined Patent Publication JP-A 2000-347507 discloses a developing device for reducing a peak-to-peak voltage of an oscillating bias voltage periodically.

In a commonly used bias voltage, the Vpp is constant and not changed, however, compared to this, when the Vpp of the oscillating bias voltage is reduced periodically like the developing device described in JP-A 2000-347507, it is possible to make the image density higher and the dot reproducibility is also improved slightly.

However, when the Vpp is increased even slightly, dot reproducibility deteriorates markedly. This is because, although the separation amount of toner from carrier is the largest in a state where the maximum Vpp is obtained, the subsequent Vpp is reduced only slightly and a force is applied greatly in the direction of returning toner from the electrostatic latent image bearing member to the developer bearing member.

SUMMARY OF THE INVENTION

An object of the invention is to provide a developing device capable of improving both image density and dot reproducibility, and an image forming apparatus including the same.

The invention provides a developing device that develops an electrostatic latent image formed on an electrostatic latent image bearing member with toner by applying an alternating voltage superimposed on a direct current voltage to a developer bearing member, wherein the alternating voltage to be applied has an alternating voltage waveform in which a development-side electrical potential to move toner from the developer bearing member to the electrostatic latent image bearing member and an opposite development-side electrical potential to move toner from the electrostatic latent image bearing member to the developer bearing member are applied so as to alternate with each other, and the alternating voltage has a first period in which each of the development-side electrical potential and the opposite development-side electrical potential is applied once and a second period in which a peak-to-peak voltage is gradually increased from an initial minimum value to a maximum value, and the initial minimum peak-to-peak voltage is applied after the maximum peak-to-peak voltage in the second period is applied.

According to the invention, there is provided a developing device that develops an electrostatic latent image formed on an electrostatic latent image bearing member with toner by applying an alternating voltage superimposed on a direct current voltage to a developer bearing member.

At this time, the alternating voltage to be applied has an alternating voltage waveform in which a development-side electrical potential to move toner from the developer bearing member to the electrostatic latent image bearing member and an opposite development-side electrical potential to move toner from the electrostatic latent image bearing member to the developer bearing member so as to alternate with each other. In addition, the alternating voltage has a first period in which each of the development-side electrical potential and the opposite development-side electrical potential is applied once and a second period in which a peak-to-peak voltage is gradually increased from an initial minimum value to a maximum value, and the initial minimum peak-to-peak voltage is applied after the maximum peak-to-peak voltage in the second period is applied.

Accordingly, it is possible to improve the image density and the dot reproducibility.

Since the image density is decided by the maximum peak-to-peak voltage, the image density the same as the image density when the maximum peak-to-peak voltage is applied at all times is obtained. There is a drawback that the dot reproducibility deteriorates when the maximum peak-to-peak voltage is applied at all times, but by gradually increasing from the initial minimum value to the maximum value, the dot reproducibility is also improved.

Furthermore, in the invention, it is preferable that the alternating voltage includes n pieces of first periods in one period of the second period, and when respective peak-to-peak voltages from the initial minimum peak-to-peak voltage to the maximum peak-to-peak voltage are changed into V(1), V(2), . . . , V(n), with elapse of time, the respective peak-to-peak voltage satisfies the following formula (1):

$$V(i) \leqq V(i+1)$$

$$V(1) < V(n) \quad (1)$$

(wherein, $1 \leqq i \leqq n-1$ (i is an integer number).)

According to the invention, the alternating voltage includes n pieces of first periods in one period of the second period, and when respective peak-to-peak voltage from the initial minimum peak-to-peak voltage to the maximum peak-to-peak voltage are changed into V(1), V(2), . . . , V(n), with elapse of time, the respective peak-to-peak voltage satisfies the following formula (1):

$$V(i) \leqq V(i+1)$$

$$V(1) < V(n) \quad (1)$$

(wherein, $1 \leqq i \leqq n-1$ (i is an integer number).)

When a peak-to-peak voltage close to the maximum is applied after the minimum peak-to-peak voltage, the dot reproducibility deteriorates. Accordingly, by gradually increasing the peak-to-peak voltage from the minimum peak-to-peak voltage to the maximum peak-to-peak voltage, it is possible to improve the dot reproducibility.

Furthermore, in the invention, it is preferable that the alternating voltage includes n pieces of first periods in one period of the second period, and when respective peak-to-peak voltages from the initial minimum peak-to-peak voltage to the maximum peak-to-peak voltage are changed into V(1), V(2), . . . , V(n), with elapse of time, the respective peak-to-peak voltages satisfy the following formula (2):

$$V(i+1) - V(i) \leqq V(i+2) - V(i+1) \quad (2)$$

(wherein, $1 \leqq i \leqq n-2$ (i is an integer number).)

According to the invention, the alternating voltage includes n pieces of first periods in one period of the second period, and when respective peak-to-peak voltages from the initial minimum peak-to-peak voltage to the maximum peak-to-peak voltage are changed into V(1), V(2), . . . , V(n), with elapse of time, the respective peak-to-peak voltages satisfy the following formula (2):

$$V(i+1) - V(i) \leqq V(i+2) - V(i+1) \quad (2)$$

(wherein, $1 \leqq i \leqq n-2$ (i is an integer number).)

Accordingly, by increasing the peak-to-peak voltage exponentially, it is possible to further improve the dot reproducibility.

Furthermore, in the invention, it is preferable that the alternating voltage is applied so that the peak-to-peak voltage that is applied lastly in the second period becomes the development-side electrical potential.

According to the invention, the alternating voltage is applied so that the peak-to-peak voltage that is applied lastly in the second period becomes the development-side electrical potential.

Accordingly, after toner has scattered in the direction of the photoreceptor, an electric field in the direction of returning toner from the photoreceptor is small. As a result, since toner that has reached a latent image on the photoreceptor once will not be separated, the image density is made higher and the dot reproducibility is also improved.

Furthermore, in the invention, it is preferable that the alternating voltage is applied so as to satisfy a condition of $T2 \geqq T1$ in the first period, wherein a time for applying the development-side electrical potential is T1 and a time for applying the opposite development-side electrical potential is T2.

According to the invention, the alternating voltage is applied so as to satisfy a condition of $T2 \geqq T1$ in the first period, wherein a time for applying the development-side electrical potential is T1 and a time for applying the opposite development-side electrical potential is T2.

When a duty ratio is reduced, the opposite development-side voltage becomes small, thus a force for separating toner from the latent image bearing member is weakened. Accordingly, compared to the case where the duty ratio is 0.5, the image density is the same and the dot reproducibility is further improved.

Furthermore, in the invention, it is preferable that the alternating voltage is applied so as to satisfy a condition of $0.25 \leqq T1/(T1+T2) \leqq 0.50$ in the first period, wherein a time for applying the development-side electrical potential is T1 and a time for applying the opposite development-side electrical potential is T2.

According to the invention, the alternating voltage is applied so as to satisfy a condition of $0.25 \leqq T1/(T1+T2) \leqq 0.50$ in the first period, wherein a time for applying the development-side electrical potential is T1 and a time for applying the opposite development-side electrical potential is T2.

In the case of $T1/(T1+T2) < 0.25$, the image density is reduced, and in the case of $T1/(T1+T2) > 0.50$, the dot reproducibility is reduced, resulting that the above-mentioned range is preferable.

Furthermore, in the invention, it is preferable that the alternating voltage is applied so as to satisfy a condition of $0.35 \leqq T1/(T1+T2) \leqq 0.45$ in the first period, wherein a time for application of the development-side electrical potential is T1 and a time for application of the opposite development-side electrical potential is T2.

According to the inventions the alternating voltage is applied so as to satisfy a condition of $0.35 \leqq T1/(T1+T2) \leqq 0.45$ in the first period, wherein a time for applying the development-side electrical potential is T1 and a time for applying the opposite development-side electrical potential is T2.

Accordingly, it is possible to further improve the image density and the dot reproducibility.

Furthermore, in the invention, it is preferable that in the alternating voltage, a frequency of the first period is 5 kHz or more and 25 kHz or less.

According to the invention, in the alternating voltage, a frequency of the first period is 5 kHz or more and 25 kHz or less.

In the case of less than 5 kHz, toner fogging increases, while in the case of higher than 25 kHz, toner does not follow an electrical field and the image density is reduced, resulting that the above-mentioned range is preferable.

Furthermore, in the invention, it is preferable that in the alternating voltage, a frequency of the first period is 8 kHz or more and 20 kHz or less.

According to the invention, in the alternating voltage, a frequency of the first period is 8 kHz or more and 20 kHz or less.

Accordingly, it is possible to further improve the image density and the dot reproducibility.

Furthermore, in the invention, it is preferable that in the alternating voltage, a periodic number of the first period included in the second period is 4 or more and 15 or less.

According to the invention, in the alternating voltage, a periodic number of the first period included in the second period is 4 or more and 15 or less.

When the included periodic number is less than 4, the dot reproducibility deteriorates, while in the case of larger than 15, deterioration in fogging is seen, resulting that the above-mentioned range is preferable.

Furthermore, in the invention, it is preferable that in the alternating voltage, a frequency of the second period is 1 kHz or more and 6.3 kHz or less.

According to the invention, in the alternating voltage, a frequency of the second period is 1 kHz or more and 6.3 kHz or less.

In the case of less than 1 kHz, toner fogging deteriorates, while in the case of higher than 6.3 kHz, it is necessary to make the frequency of the first period not less than 25 kHz, toner does not follow an electric field and the image density is reduced. As a result, the above-mentioned range is preferable.

Furthermore, in the invention, it is preferable that in the alternating voltage, a center voltage for every first period is linearly shifted to the development side or the opposite development side.

According to the invention, in the alternating voltage, a center voltage for every first period is linearly shifted to the development side or the opposite development side.

When shifted to the development side, it is possible to further increase the image density. When shifted to the opposite development side, it is possible to further increase the dot reproducibility.

Furthermore, the invention provides an image forming apparatus comprising at least an image bearing member, a detecting section for detecting a density of a reference toner image formed on a surface of the image bearing member, a process control section for adjusting an image density by correcting a setting value of a direct current voltage applied to a development bearing member in accordance with the density of the reference toner image detected by the detecting section, and the developing device mentioned above, wherein switching can be carried out between a normal alternating voltage that applies a constant peak-to-peak voltage and the alternating voltage, and while applying the normal alternating voltage, when the direct current voltage reaches a predetermined voltage or more, switching to the alternating voltage is carried out.

According to the invention, provided is an image forming apparatus comprising at least an image bearing member, a detecting section for detecting a density of a reference toner image formed on a surface of the image bearing member, a process control section for adjusting an image density by correcting a setting value of a direct current voltage applied to a development bearing member in accordance with the density of the reference toner image detected by the detecting section, and the developing device mentioned above.

Switching can be carried out between a normal alternating voltage that applies a constant peak-to-peak voltage and the alternating voltage, and while applying the normal alternating voltages when the direct current voltage reaches a predetermined voltage or more, switching to the alternating voltage is carried out.

When the direct current voltage reaches a predetermined voltage or more, there is a case where a charge amount of toner is too high to adjust the image density. Then, by switching the alternating voltages, it is possible to control the image density stably.

Furthermore, in the invention, it is preferable that the developer is two-component developer including toner and carrier.

According to the invention, two-component developer including toner and carrier is used as the developer.

When the maximum peak-to-peak voltage is increased, toner is likely to separate from carrier and the utilization efficiency of toner is enhanced. Accordingly, unevenness in standing is less likely to be conspicuous and it is suitable for development using two-component developer

BRIEF DESCRIPTION OF THE DRAWINGS

Other and further objects, features, and advantages of the invention will be more explicit from the following detailed description taken with reference to the drawings wherein:

FIG. 10 is a view showing evaluation results of toner fogging and the image density when the frequency of the first period is changed;

FIG. 11 is a view showing the evaluation results of dot reproducibility and toner fogging when the first periodic number included in one period of the second period is changed;

FIG. 14 is a view showing evaluation results of image density and dot reproducibility when the duty ratio is changed;

DETAILED DESCRIPTION

Figure 1:
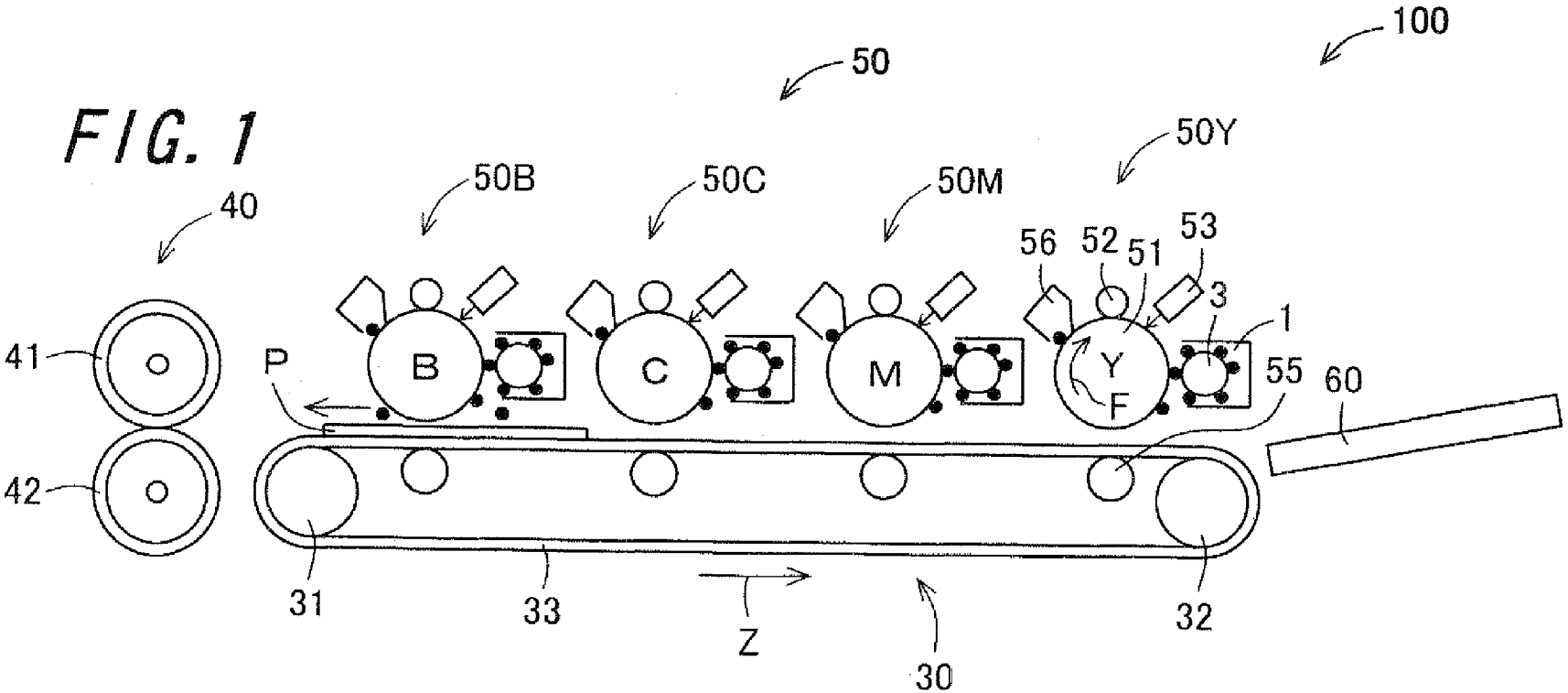
FIG. 1 is a schematic view showing an outline of the entire structure of an image forming apparatus according to a first embodiment of the invention.

Now, referring to the drawings, preferred embodiments of the invention will be described in detail. Note that, any components substantially having the same functional structure in this Specification and drawings are denoted by the same alphanumeric references, with repeated description thereof omitted.

First, description will be given for the structure of an image forming apparatus according to the invention with reference to the drawing. FIG. 1 is a schematic view showing an outline of the entire structure of an image forming apparatus according to a first embodiment of the invention. Note that, FIG. 1 shows an example in which the primary components of the image forming apparatus 100 of this embodiment are mainly described and a part of which is simplified, without any limitation to the structure of the image forming apparatus according to the invention.

The image forming apparatus 100 is a tandem type color image forming apparatus capable of forming a color image, which includes a plurality of photoreceptors 51 serving as an electrostatic latent image bearing member (in this embodiment, four photoreceptors for yellow images, magenta images, cyan images, and black images). The image forming apparatus 100 has a printer function of forming a color image or a monochrome image on a sheet P serving as a transfer receiving member (recording medium) based on image data transmitted from various kinds of information processing terminal apparatus (not shown) such as a PC (Personal Computer) connected through a network (not shown) or image data read by a document reading apparatus (not shown) such as a scanner.

As shown in FIG. 1, the image forming apparatus 100 includes an image forming station section 50 (50Y, 50M, 50C, and 50B) having a function of forming an image on the sheet P, a fixing apparatus 40 having a function of fixing a toner image formed on the recording medium P at the image forming station section 50, and a transport section 30 having a function of transporting the recording medium P from a feed tray 60 on which the recording medium P is placed to the image forming station section 50 and the fixing apparatus 40.

The image forming station section 50 is configured with four image forming stations 50Y, 50M, 50C, and 50B for yellow images, magenta images, cyan images, and black images, respectively.

Specifically, the yellow image forming station SOY, the magenta image forming station 50M, the cyan image forming station 50C, and the black image forming station 50B are disposed in this order from the side of the feed tray 60 between the feed tray 60 and the fixing apparatus 40.

The image forming stations SOY, 50M, 50C, and 50B for the respective colors have substantially the same structure, and form yellow, magenta, cyan, and black images according to image data corresponding to the respective colors so that the images are eventually transferred onto the sheet P serving as the transfer receiving member (recording medium).

Note that, in FIG. 1, the components of the respective image forming station section are shown with alphanumeric references on the yellow image forming station 50Y as a representative, and the alphanumeric references of the components of the other image forming stations 50N, 50C, and 50B are omitted.

The image forming stations 50Y, 50M, 50C, and 50B respectively includes the photoreceptor 51 serving as a latent image bearing member on which an electrostatic latent image is formed, and a charging device 52, an exposure unit 53, a developing device 1, a transfer device 55, and a cleaning unit 56 are disposed in the circumferential direction around the photoreceptor 51.

The photoreceptor 51 is in the shape of a substantially cylindrical drum on the surface of which a photosensitive material such as an OPC (Organic Photoconductor) is provided, and is disposed below the exposure unit 53 and controlled so as to be rotationally driven in a predetermined direction (in the direction shown with an arrow F in the figure) by a driving section and a control section.

The charging device 52 is a charging section that uniformly charges the surface of the photoreceptor 51 to a predetermined potential, and is disposed above the photoreceptor 51 so as to be close to a peripheral surface thereof. In this embodiment, a roller system charging roller in a contact type is used, but a charging device in a charger type or a brush type may be used as a substitution therefor.

The exposure unit 53 has a function of exposing the surface of the photoreceptor 51 that is charged with the charging device 52 by irradiating it with laser light based on image data outputted from an image processing section (not shown) to thereby write and form an electrostatic latent image according to the image data on the surface. The exposure unit 53 forms an electrostatic latent image in a corresponding color when image data that corresponds to yellow, magenta, cyan, or black is inputted respectively according to the image forming stations SOY, 50N, 50C, or 50B. As the exposure unit 53, a laser scanning unit (LSU) including a laser irradiation section and a reflection mirror or a write device (for example, a write head) in which light emitting elements such as ELs and LEDs are arranged in an array is usable.

The developing device 1 has a developing roller 3 serving as a developer bearing member that bears developer. The developing roller 3 is configured so that developer is transported to a development region in which toner can move to the photoreceptor 51. In this embodiment, the developing device 1 uses two-component developer including toner and carrier, and forms a toner image (visible image) by performing reversal development with the toner of an electrostatic latent image that has been formed on the surface of the photoreceptor 51 by the exposure unit 53.

The developing device 1 contains yellow, magenta, cyan, or black developer according to image formation of the respective image forming stations 50Y, 50M, 50C, and 50B. The developer includes toner that is charged with a polarity the same as the surface potential that is charged to the photoreceptor 51. Note that, the polarity of the surface potential that is charged to the photoreceptor 51 and the charged polarity of the toner used are both negative in this example.

The transfer device 55 transfers a toner image on the photoreceptor 51 to the transfer receiving member P that is transported by a transport belt 33, and is provided with a transfer roller to which a bias voltage that has a polarity (positive in this example) opposite to the charged polarity of the toner is applied.

The cleaning unit 56 removes and collects the toner remaining on the peripheral surface of the photoreceptor 51 after the development and image transfer to the sheet P serving as the transfer receiving member. In this embodiment, the cleaning unit 56 is disposed substantially horizontally in the side of the photoreceptor 51 at a position substantially facing the developing device 1 across the photoreceptor 51 (in the left side in FIG. 1).

The transport section 30 includes a drive roller 31, a driven roller 32, and the transport belt 33, and transports the transfer receiving member P to which toner images in the respective colors are transferred in the image forming stations 50Y, 50M, 50C, and SOB. The transport section 30 is configured so that the endless transport belt 33 is routed around the drive roller 31 and the driven roller 32, and transports the sheet P serving as the transfer receiving member (recording medium) that is fed from the feed tray 60 to each of the image forming stations 50Y, 50M, 50C, and 50B sequentially.

The fixing apparatus 40 includes a heat roller 41 and a pressure roller 42, and by transporting the transfer receiving member P to a nip portion, applies heat and pressure to the toner image transferred to the sheet P to fix on the sheet P.

Moreover, the image forming apparatus 100 of this embodiment includes a bias voltage applying section 110 (referring to FIG. 2) that applies an oscillating bias voltage to the developing roller 3 so that a potential difference between the developing roller 3 and the photoreceptor 51 is changed continuously and periodically. The oscillating bias voltage is a voltage in which a development-side electrical potential that can apply a force to the toner to be charged in the direction from the developing roller 3 to the photoreceptor 51 and an opposite development-side electrical potential that can apply a force to the toner to be charged in the direction from the photoreceptor 51 to the developing roller 3 alternate with each other. The application of the oscillating bias voltage will be described in detail later.

In the image forming apparatus 100 in such a configuration, when the sheet P that is transported by the transport section 30 passes positions at which the photoreceptor 51 faces the respective image forming stations 50Y, 50M, 50C, and 50B, the toner images on the respective photoreceptors 51 are successively transferred to the sheet P with the action of a transfer electric field of the transfer rollers that is disposed below the facing positions thorough the transport belt 33. This layers toner images in the respective colors on the sheet P to form a desired full-color image on the sheet P. The sheet P serving as the transfer receiving member on which the toner image is transferred in such a manner is subjected to a fixing process of the toner image at the fixing apparatus 40 and thereafter is discharged to a discharge tray (not shown).

Figure 2:
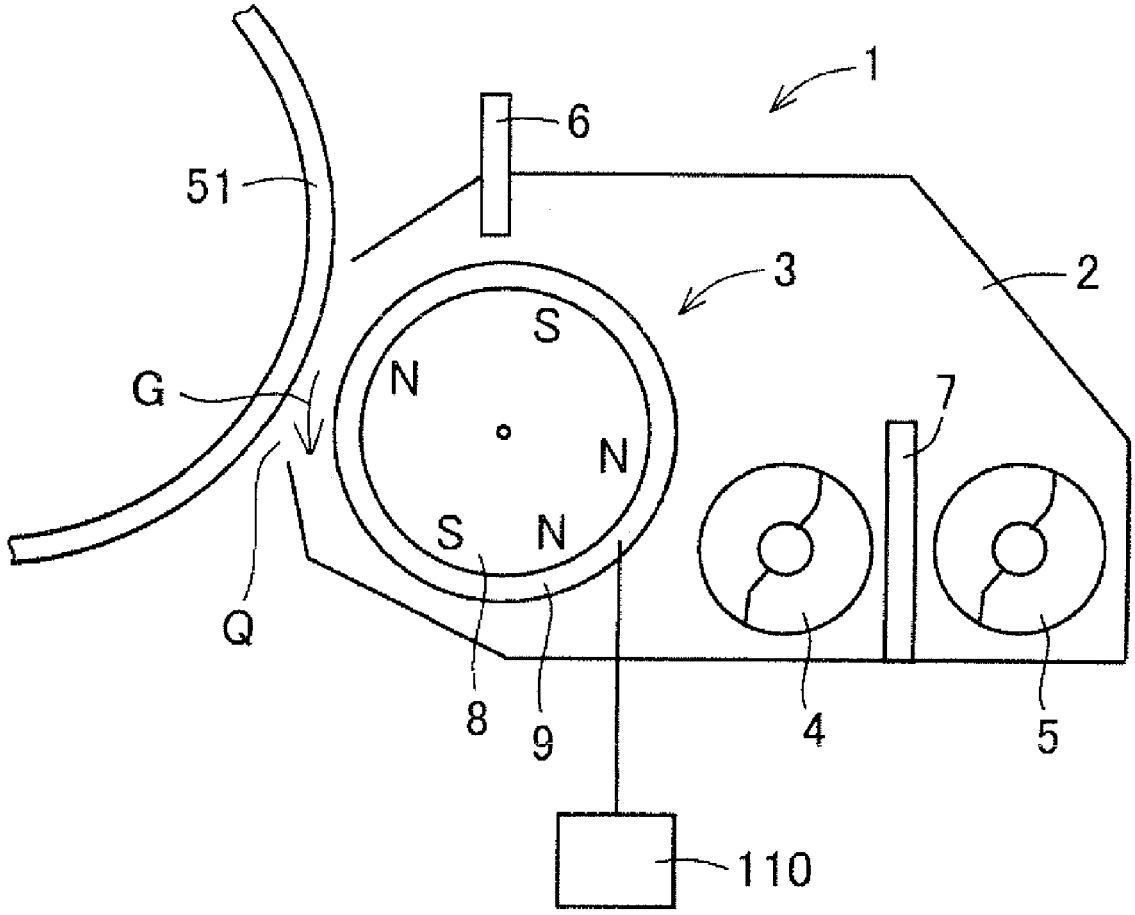
FIG. 2 is a schematic view showing an outline of the structure of the developing device in the respective image forming stations shown in FIG. 1.

Next, the structure of the developing device 1 will be described with reference to the diagram. FIG. 2 is a schematic view showing an outline of the structure of the developing device 1 in the respective image forming stations shown in FIG. 1. Note that, FIG. 2 shows an example in which the primary components of the developing device 1 are mainly described and a part of which is simplified, without any limitation to the structure of the developing device according to the invention.

As shown in FIG. 2, the developing device 1 includes, in addition to the above-described developing roller 3, a regulation blade 6 serving as a regulation member that regulates the layer thickness of developer on the developing roller 3, a pair of agitating/conveying screws 4 and 5 serving as agitating/conveying members that convey the developer to the developing roller 3 and agitate the developer, and a development tank 2 that contains two-component developer including toner and carrier.

In the development tank 2, the pair of agitating/conveying screws 4 and 5 are disposed so that axis cores thereof are substantially in parallel to each other. A partition 7 is provided between the agitating/conveying screws 4 and 5 so as to partition the center part therebetween except for both end sides in the axial line direction. By providing the partition 7 in the development tank 2 in this way, separate developer conveying paths are formed on both sides of the partition 7 within the development tank 2. In addition, in the developing device 1, toner in the developer contained in the development tank 2 is agitated with carrier by an agitation operation of the agitating/conveying screws 4 and 5 disposed in the development tank 2 so as to be frictionally charged.

Moreover, an opening section for development Q is provided at a position in the development unit 2 that faces the photoreceptor 51, and the developing roller 3 is disposed in the development tank 2 in a state where a part of which is exposed from the opening section Q of the development unit 2 with a development gap (about 0.3 to 1.0 mm) between the photoreceptor 51.

The developing roller 3 has a magnet roller 8 in which a plurality of magnetic pole members are arranged along the circumferential direction, and a nonmagnetic development sleeve 9 formed with aluminum alloy and brass in a substantially cylindrical shape that is fitted in the magnet roller 8 so as to rotate freely in a fixed direction (in the direction shown with arrow G in FIG. 2), and is configured so that the development sleeve 9 is rotationally driven in a predetermined direction (in the direction shown with arrow G in FIG. 2) by a control section and driving section (not shown).

The developer is two-component developer including toner and carrier that is composed of a magnetic substance. The developer is attracted to the surface of the development sleeve 9 by the magnetic force of the magnet, and is conveyed on the development sleeve 9 along the rotational direction G of the development sleeve 9. At this time, the carrier is attracted to the surface of the development sleeve 9 by the magnetic force of the magnet roller 8 so as to form a magnetic brush, and the toner is attached to the carrier by Coulomb force due to the frictional charge.

In addition, a tip portion of the regulation blade 6 is disposed so as to face the development sleeve 9 in the upstream side of the rotational direction G of the development sleeve 9 in the opening section for development Q. In this embodiment, the regulation blade 6 is configured so that the layer thickness of developer formed on the surface of the developing roller 3 is regulated.

By configuring the developing device 1 of this embodiment as described above, the developing device 1 forms a toner image by supplying a constant amount of developer to a position that faces the photoreceptor 51, attracting the toner in the developer supplied to the facing position with the electrostatic force of an electrostatic latent image formed on the surface of the photoreceptor 51, and developing the electrostatic latent image. Also, in the developing device 1, the carrier and the toner that has not been used for development of the developer supplied to the facing position returns into the development tank 2 with the rotation of the development sleeve 9.

Next, a development operation executed in the developing device 1 of this embodiment will be described with reference to the diagrams.

In the following experiment data, images were outputted using a multifunctional peripheral MX-7001N manufactured by Sharp Corporation, unless otherwise noted. However, various development bias voltage waveforms that have been outputted using an arbitrary waveform generator (product name: HIOKI 7075, manufactured by HIOKI E.E. Corporation) and an amplifier (product name: HVA4321, manufactured by NF Circuit Design Bloc) were used. Note that, toner that has a volume average particle size of 7 μm and carrier that has a volume average particle size of 40 μm were used for experiments. The charged amount of the toner in experiments was about 25 μC/g.

In addition, in the image density, the solid image density was measured with a portable spectral colorimetric densitometer (product name: X-Rite 939, manufactured by X-Rite Company). The dot was evaluated simply by printing an isolated dot in which printing is made for one dot and no printing is made for eight dots and measuring the image density of an area including the isolated dot. Moreover, fogging was evaluated by measuring a density of an unprinted part and taking a difference with a density of a sheet that has not been subjected to a printing process. The densitometer used for evaluation of the dot and fogging is the same as the densitometer used for measuring a solid density.

Figure 3:
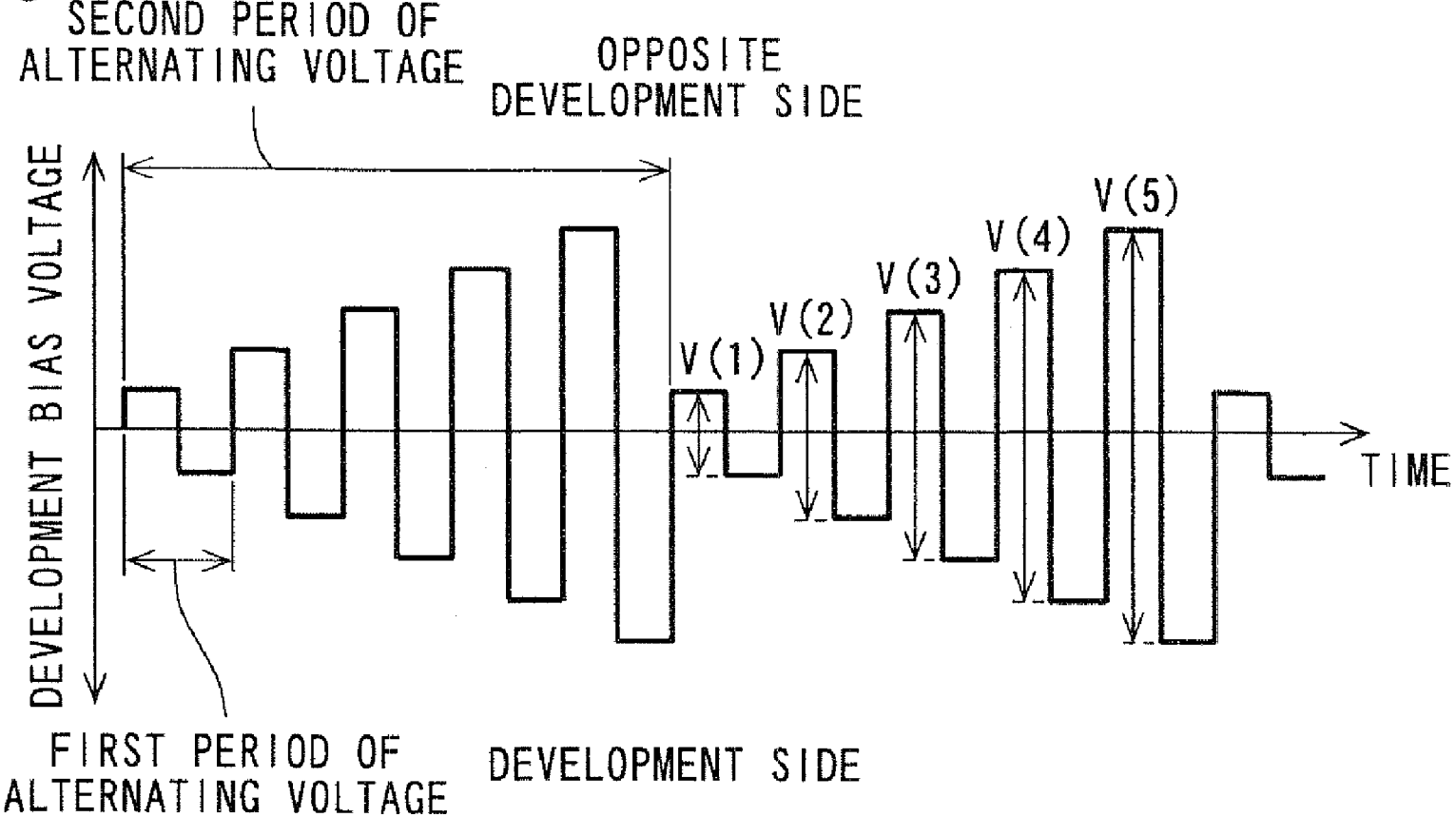
FIG. 3 is a view showing a development bias voltage waveform applied to the developing roller according to the first embodiment.

The bias voltage applying section 110 applies a bias voltage that has a waveform as shown in FIG. 3 to the development sleeve 9 of the developing roller 3 which is a development bias voltage as an alternating voltage in which a development-side electrical potential that applies a force to move the toner from the developing roller 3 to the photoreceptor 51 and an opposite development-side electrical potential that applies a force to move the toner from the photoreceptor 51 to the developing roller 3 alternate with each other periodically.

As shown in the waveform of FIG. 3, in this embodiment, repeatedly, the peak-to-peak voltage (hereinafter referred to as Vpp) of the bias voltage is gradually increased from the initial Vpp and decreased at once to the initial Vpp after a constant period has passed, and the Vpp is gradually increased again. By increasing the Vpp gradually, the toner is likely to separate from the carrier, and the toner is most likely to scatter from the toner when the Vpp is maximum. The scattering amount at this time is substantially the same as the case where the same Vpp is always repeated. In addition, by decreasing the Vpp temporarily from the maximum Vpp to the initial Vpp, the dot reproducibility is improved. It is considered that this is because a stable dot is formed while the toner scattered when the Vpp is maximum is moved to a dot latent image slowly.

In this way, the bias voltage waveform has an original period (first period) in which each of a development-side electrical potential and an opposite development-side electrical potential is applied once, and a period (second period) in which the Vpp is gradually increased from the initial value to the maximum value.

In other words, in the development bias voltage in the invention, n pieces of first periods are included in one period of the second period, and when respective peak-to-peak voltages from the initial minimum peak-to-peak voltage to the maximum peak-to-peak voltage are changed into V(1), V(2), . . . , V(n), with elapse of time, the respective peak-to-peak voltage satisfy the following formula (1):

$$V(i) \leqq V(i+1)$$

$$V(1) < V(n) \quad (1)$$

(wherein, $1 \leqq i \leqq n-1$ (i is an integer number).)

The example shown in FIG. 3 shows that the Vpp is changed by the same amount in the second period. A frequency of the second period is 2 kHz, a frequency of an alternating voltage of the first period is 10 kHz, V(1) as the Vpp of the initial alternating voltage is 0.4 kV, V(2) as the Vpp of the subsequent alternating voltage is 0.8 kV, the V(3) as the third Vpp is 1.2 kV, V(4) as the fourth Vpp is 1.6 kV, and V(5) as the last maximum Vpp is 2 kV. The Vpp is increased by 0.4 kV.

Moreover, the waveform for one period in the first period is symmetrical, which shows an example in which the time for applying the voltage in the direction of moving toner from the developing roller 3 to the photoreceptor 51 is the same as the time for applying the voltage in the direction of moving toner from a latent image bearing member to a developer bearing member.

Figure 4:
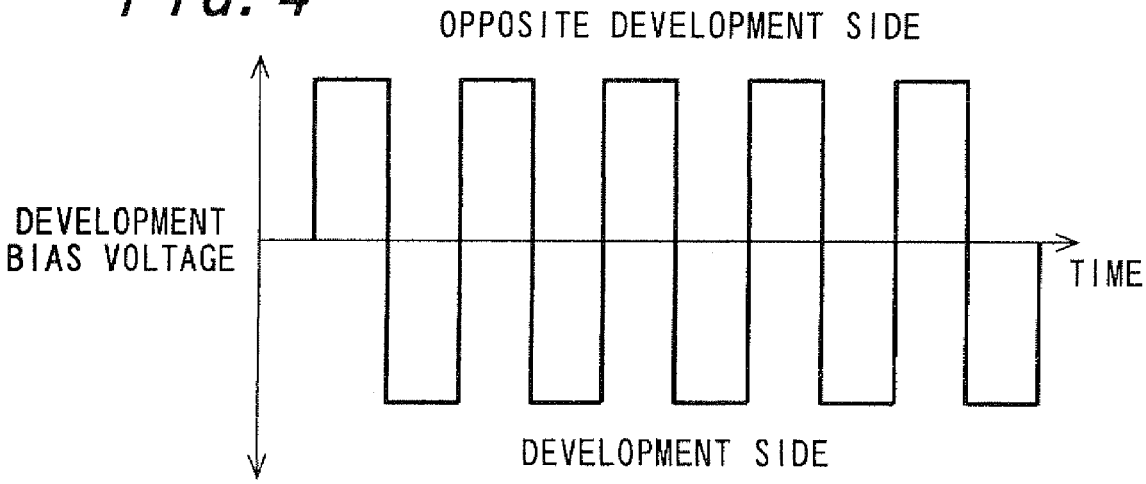
FIG. 4 is a view showing a conventional development bias voltage waveform.

The image density and the dot reproducibility when this development bias voltage waveform is used (example 1), and a normal voltage in which the same Vpp is repeated without changing the Vpp as shown in FIG. 4 (when two waveforms of Duty 50% and Vpp=1 kV (comparative example 1) r and Duty 50% and Vpp=2 kV (comparative example 2) are used), that is a bias voltage that does not have the second period were compared.

Figure 5:
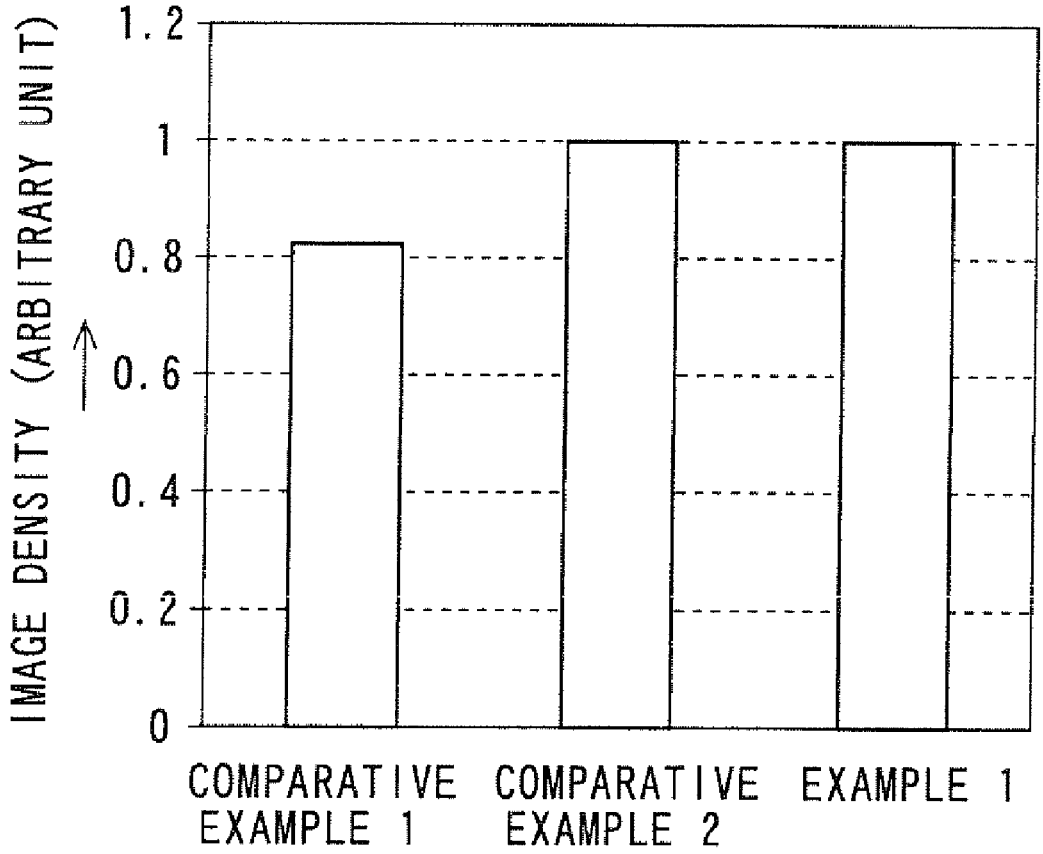
FIG. 5 is a graph showing comparison results of image density between Example and Comparative examples.

FIG. 5 is a graph showing comparison results of image density between Example and Comparative examples. The vertical axis shows the image density with the relative value with Comparative example 2 as a reference (1.0). By using the development bias voltage of Example 1, the density the same as the case of Comparative example 2 multiplied by Vpp=2 kV is obtained, which shows that higher density is obtained than Comparative example 1 multiplied by Vpp=1 kV.

Figure 6:
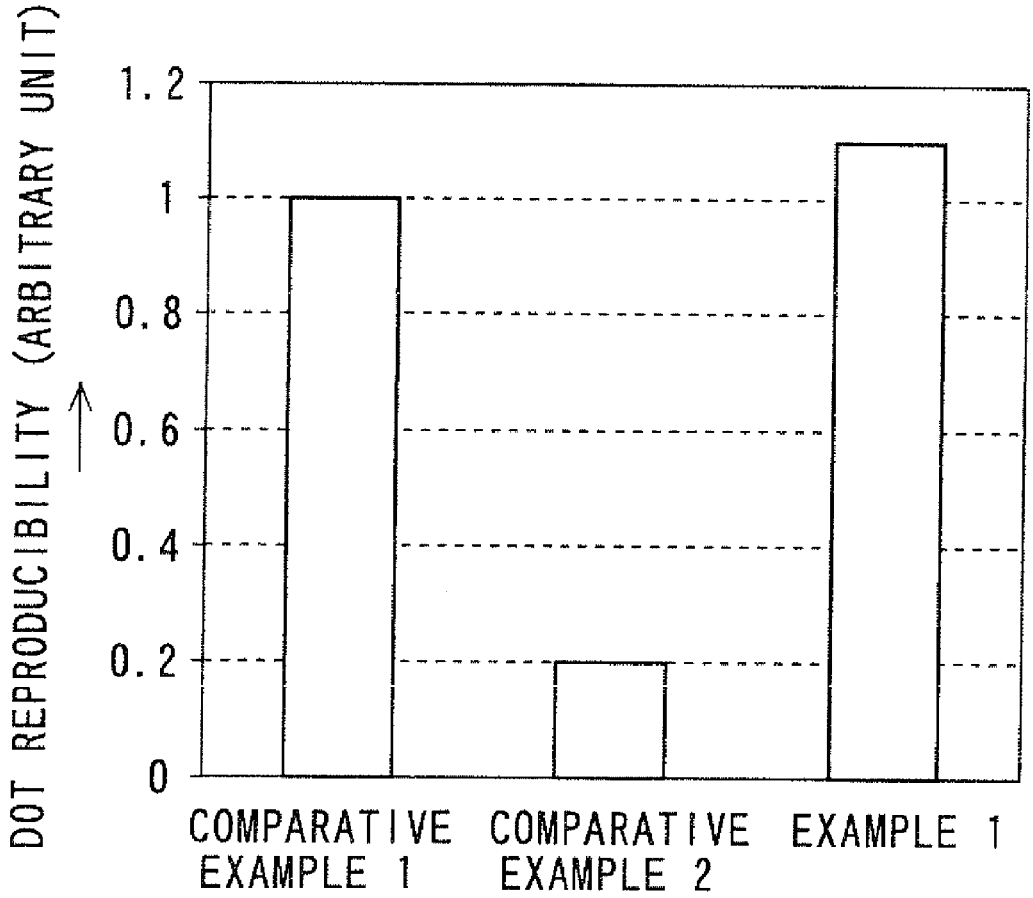
FIG. 6 is a graph showing comparison results of dot reproducibility between Example and Comparative examples.

FIG. 6 is a graph showing comparison results of dot reproducibility between Example and Comparative examples. The vertical axis shows the dot reproducibility with the relative value with Comparative example 1 as a reference (1.0). As shown from the graph of FIG. 6, while the dot reproducibility is very low in Comparative example 2 with Vpp=2 kV, by using the bias voltage waveform of Example 1, it is possible to obtain the dot reproducibility at the same level as Comparative example 1 with Vpp=1 kV.

The experimental results of FIGS. 5 and 6 show that by performing development using the bias voltage waveform as shown in Example 1, the image density equal to the case where the Vpp is large is obtained, while the dot reproducibility at the same level as the case where the Vpp is small is obtained.

Note that, in the bias voltage waveform shown in FIG. 3, at the last Vpp in the second period, a development-side electrical potential to which an electric field in the direction of moving toner from the developing roller 3 to the photoreceptor 51 is applied is applied.

Figure 7:
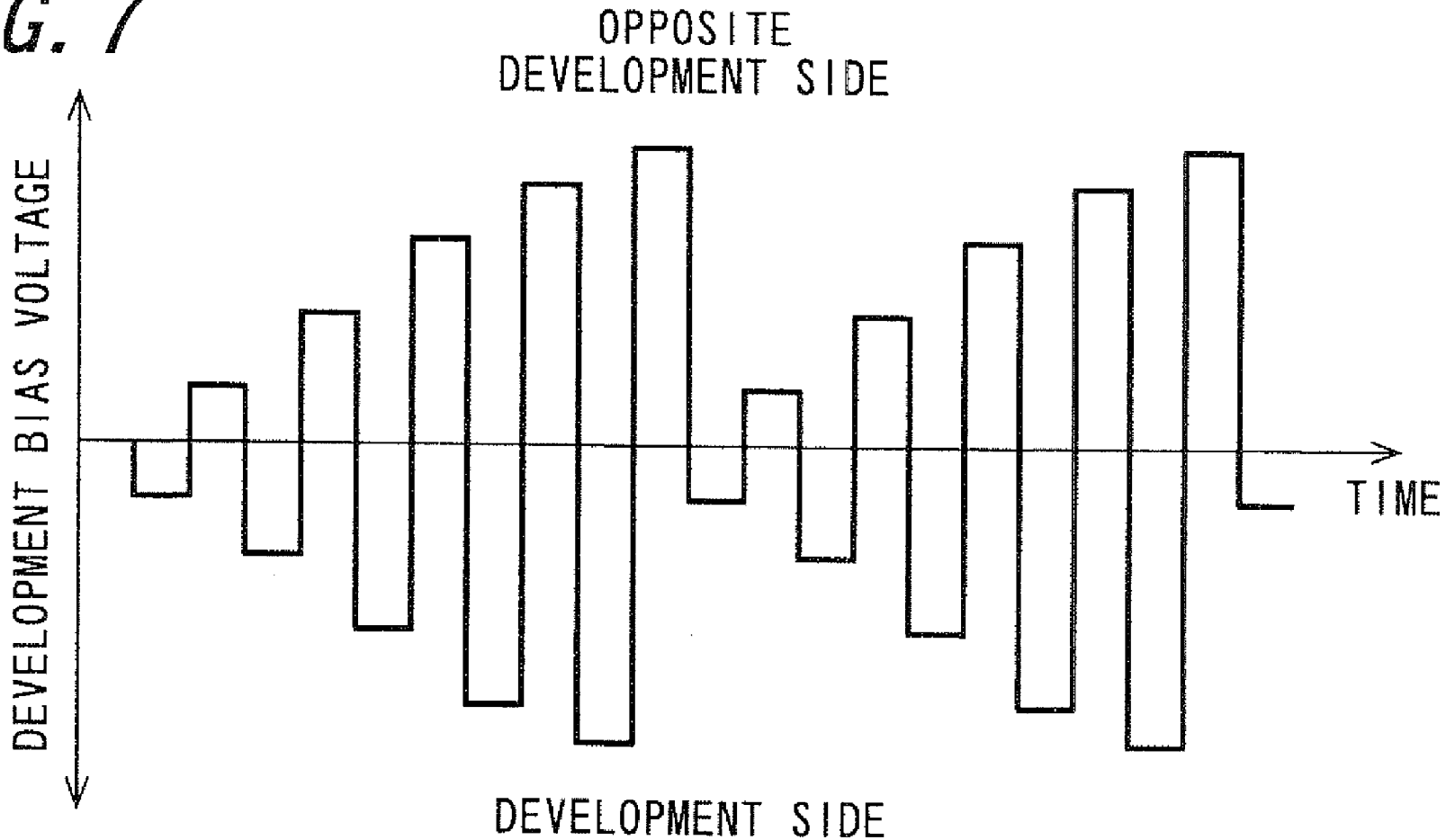
FIG. 7 is a view showing the development bias voltage waveform applied in Comparative example 3.

Against this, compared is the case where the lastly applied Vpp applies an opposite development-side electrical potential having the waveform opposite to that shown in FIG. 3, that is, to which an electric field in the direction of moving toner from the photoreceptor 51 to the developing roller 3 is applied (comparative example 3. FIG. 7 shows the bias voltage waveform applied in Comparative example 3.

Figure 8:
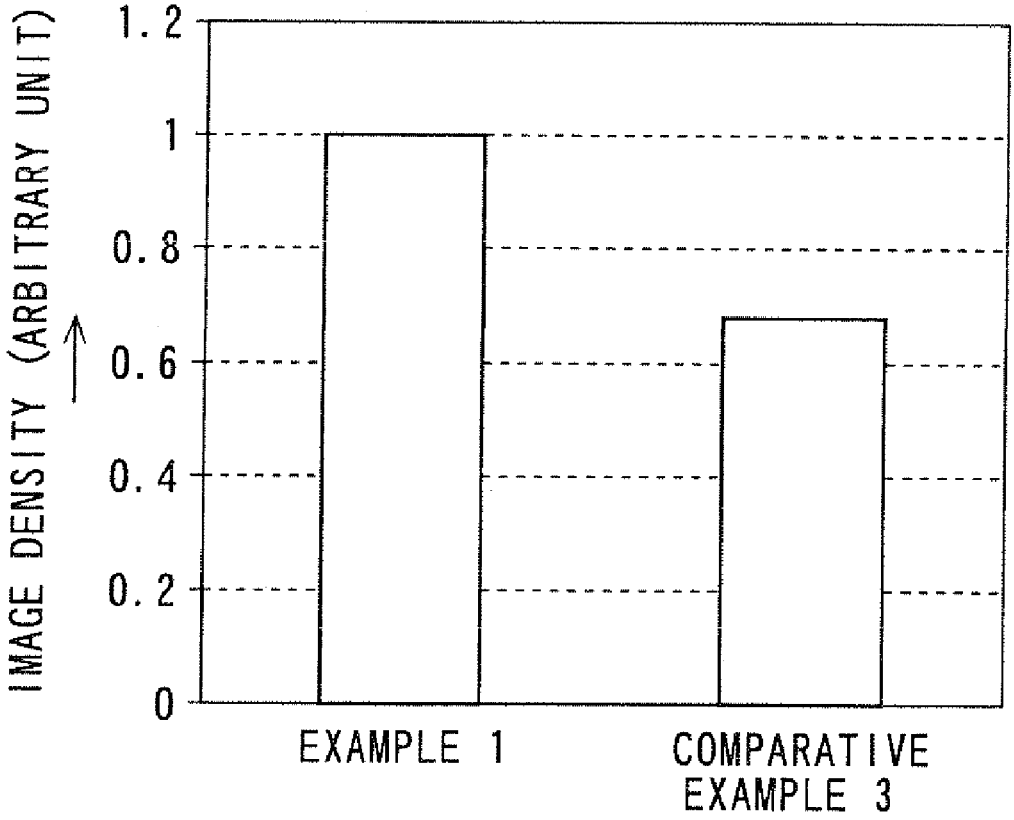
FIG. 8 is a graph showing comparison results of image density between Example and Comparative example.

FIG. 8 is a graph showing comparison results of image density between Example and Comparative example. The vertical axis shows the image density with the relative value with Example 1 as a reference (1.0). Compared to Comparative example 3, higher image density was obtained in the case of Example 1.

Figure 9:
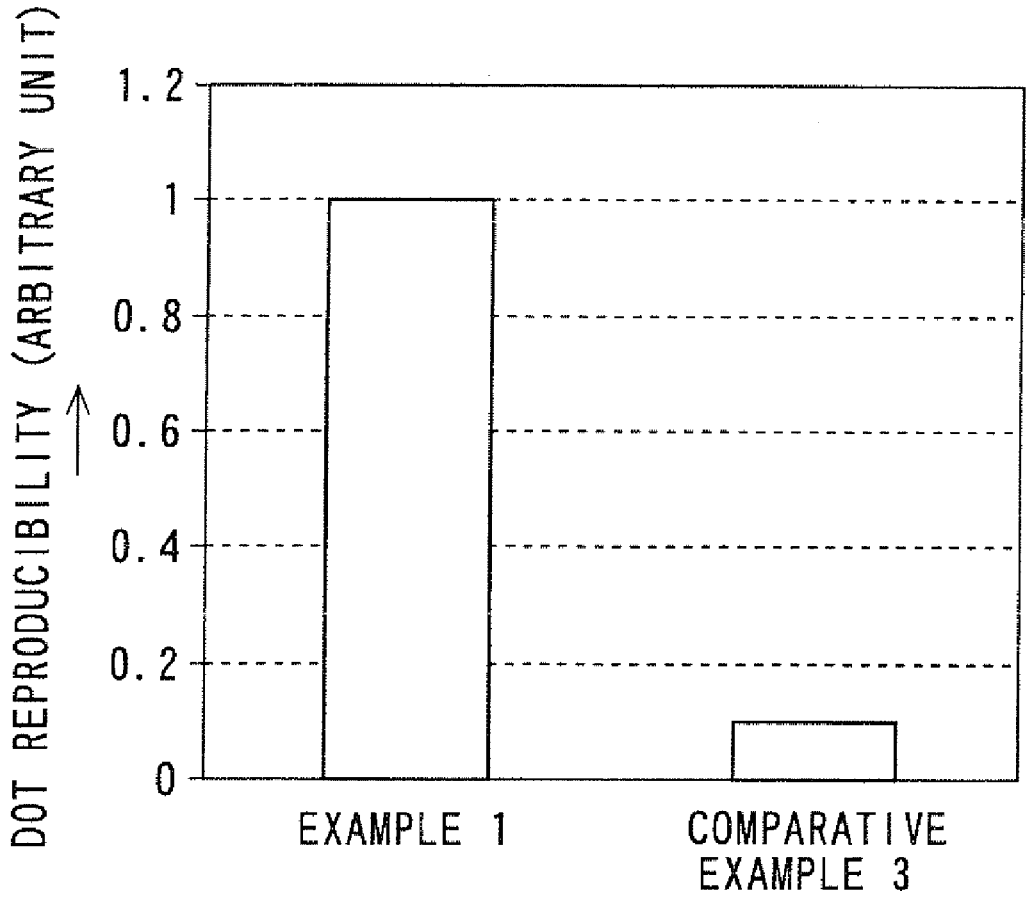
FIG. 9 is a graph showing comparison results of dot reproducibility between Example and Comparative example.

In addition, FIG. 9 is a graph showing comparison results of dot reproducibility between Example and Comparative example. The vertical axis shows the dot reproducibility with the relative value with Example 1 as a reference (1.0). Compared to Comparative example 3, it is shown that higher dot reproducibility was obtained in the case of Example 1.

This shows that it is important that the maximum Vpp is finished in a state where the development-side electrical potential to which an electric field in the direction of moving toner from the developing roller 3 to the photoreceptor 51 is applied is applied and the Vpp is decreased in a state where the toner goes toward the photoreceptor 51. Accordingly, while the toner is likely to be developed on an electrostatic latent image, the toner is also developed on a dot latent image slowly, resulting in high image density and high dot reproducibility.

On the other hand, when an alternating voltage having the maximum Vpp is finished in a state where the opposite development-side electrical potential is applied, the Vpp is decreased in a state where an electric field is applied in the direction where the toner returns to the developing roller 3, thus the toner hardly goes toward the photoreceptor 51 and the dot reproducibility is reduced. This causes the result in which the image density is low and the dot reproducibility is poor.

Accordingly, it is necessary that the maximum Vpp is finished in a state where the development-side electrical potential to which an electric field in the direction of moving toner from the developing roller 3 to the photoreceptor 51 is applied is applied.

In Example 1, a frequency of the first period of an alternating voltage is 10 kHz. Description will be given for the influence when the frequency of the first period is changed.

FIG. 10 is a view showing evaluation results of toner fogging and the image density when the frequency of the first period is changed. With respect to the image density, in this example, when a direct current voltage of the development bias voltage is 400 V, the case where the image density of 1.5 or more is obtained is represented as favorable (mark "GOOD"), the case where the image density is between 1.3 and 1.5 is represented as practicable (mark "AVAILABLE"), and the case where the image density is less than 1.3 is represented as unusable (mark "POOR").

With respect to toner fogging, in this example, as a development condition in which toner fogging is more likely to occur than usual, when a direct current voltage of the development bias voltage is 400 V and a non-image portion electrical potential of the photoreceptor is 450 V, the case where the measured fogging density is 0.005 or less is represented as favorable (mark "GOOD"), the case where the fogging density is from 0.005 to 0.01 is represented as practicable (mark "AVAILABLE"), and the case where the fogging density is 0.01 or more is represented as unusable (mark "POOR").

When the frequency of the first period is high, it is impossible that the toner movement is followed up between the developing roller 3 and the photoreceptor 51, resulting in decrease in the image density. On the other hand, when the frequency is low, the toner fogging becomes prominent. Accordingly, the usable range of the first frequency is a range where practical use is capable in both image density and toner fogging. According to FIG. 10, the usable range is a range from 5 kHz to 25 kHz, preferably, 8 kHz to 20 kHz.

In the bias voltage waveform of Example 1 shown in FIG. 3, one period of the second period corresponds to five periods of the first period, and during one period of the second period, change from the development-side electrical potential to the opposite development-side electrical potential is repeated five times. Description will be given for the influence when the first periodic number included in one period of the second period is changed.

As a frequency of the first period of an alternating voltage, 10 kHz was used. The initial Vpp and the maximum Vpp were defined as 0.4 kV and 2 kV, respectively, and the Vpp therebetween was decided so as to be changed by the same amount based on the periodic number. For example, when three periods are included, the first period is 0.4 kV, the second period is 1.2 kV, and the third period is 2 kV.

FIG. 11 is a view showing the evaluation results of dot reproducibility and toner fogging when the first periodic number included in one period of the second period is changed. In the dot reproducibility, the case equal to Comparative example 1 or more is represented as favorable (mark "GOOD"), the case inferior thereto is represented as unusable (mark "POOR").

When the first periodic number included in one period of the second period is 3, the dot reproducibility deteriorates. Although the maximum Vpp is applied and thereafter the initial Vpp is applied, since the Vpp of the alternating voltage applied subsequently is large, a large electric field toward the direction of the developing roller 3 is applied before the toner that has been toward the photoreceptor 51 reaches a dot latent image, thus the dot reproducibility is considered to deteriorate.

Moreover, when the first periodic number included in the second period is increased to be more than 15, the frequency of the second period is reduced and unevenness in an image is likely to be generated, thus the reproducibility of a part of the dot is reduced. Further, the fogging is also increased.

As a result, it is desirable that the first periodic number included in one period of the second period falls within 4 or more and 15 or less.

In the bias voltage waveform of Example 1 shown in FIG. 3, the frequency of the second period is 2 kHz. Description will be given for the influence when the frequency of the second period is changed.

When a linear speed of the photoreceptor 51 is 200 mm/sec and a development region is 2 mm, the time for passing of the surface of the photoreceptor 51 through the development region is 0.01 sec, and is 100 Hz when converted into a frequency. In order to reduce unevenness and improve graininess, it is necessary to move toner ten times or more repeatedly while the surface of the photoreceptor 51 passes the development region. Accordingly, the second frequency of at least 100 Hz×10=1 kHz or more is necessary.

In addition, based on the above-described two evaluation results, the second frequency becomes maximum when the frequency of the first period is maximum 25 kHz and the first periodic number included in one period of the second period is minimum four times, and the maximum second frequency is therefore 6.3 kHz.

As a result, the frequency of the second period is preferably 1 kHz or more and 6.3 kHz or less.

Next, a second embodiment of the invention will be described. In this embodiment, the waveform of the development bias voltage is different from that of the first embodiment.

Figure 12:
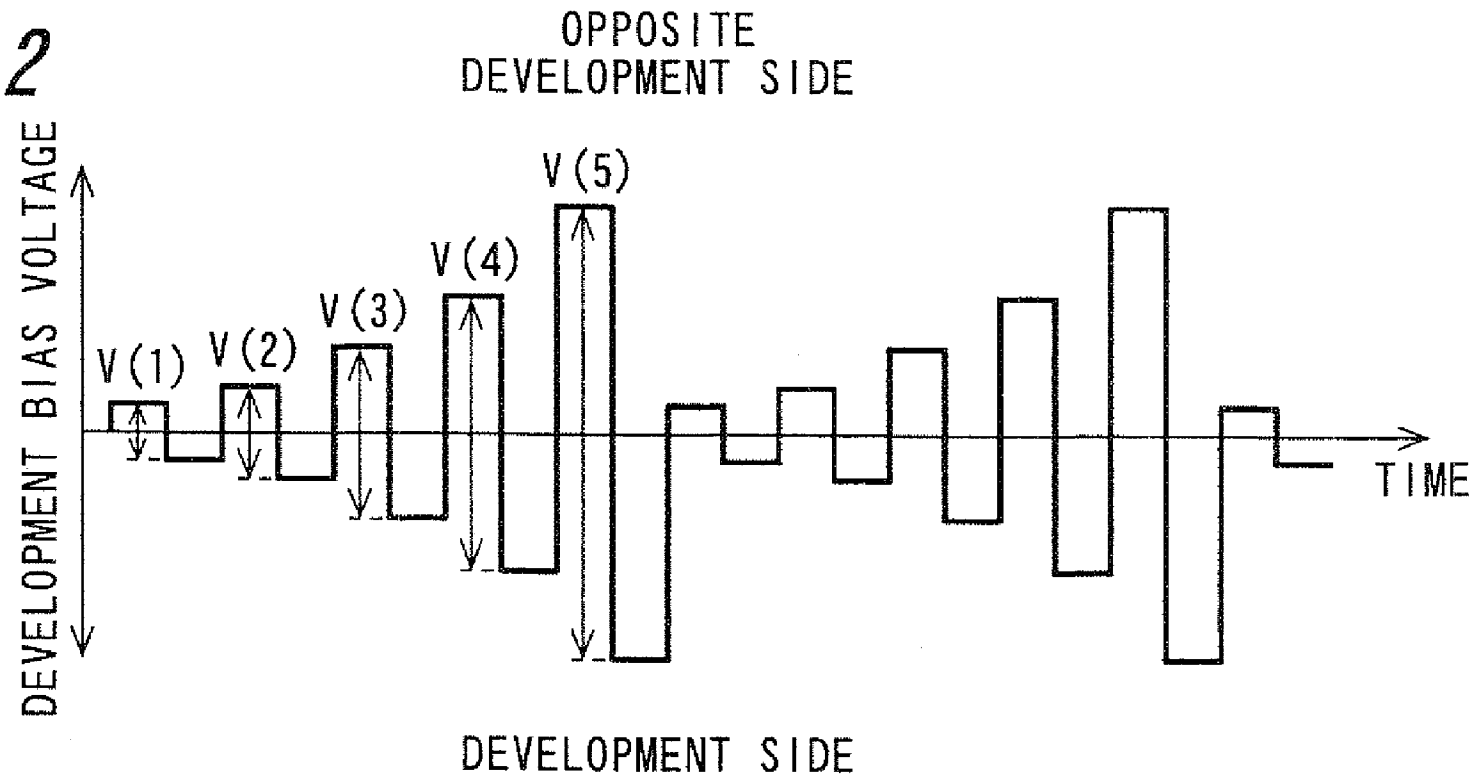
FIG. 12 is a view showing the waveform of the development bias voltage in a second embodiment.

FIG. 12 is a view showing the waveform of the development bias voltage in the second embodiment.

Although it is the same in terms of that the Vpp is gradually increased from the initial Vpp to the maximum Vpp, it is different from the waveform in the first embodiment in terms of that the Vpp is increased not linearly but exponentially.

In other words, in this embodiment, n pieces of first periods are included in one period of the second period, and when respective peak-to-peak voltages from the initial minimum peak-to-peak voltage to the maximum peak-to-peak voltage are changed into V(1), V(2), . . . , V(n), with elapse of time, the respective peak-to-peak voltages satisfy the following formula (2):

$$V(i+1)-V(i) \leqq V(i+2)-V(i+1) \quad (2)$$

(wherein, $1 \leqq i \leqq n-2$ (i is an integer number).)

In the waveform of this embodiment, V(1)=0.4 kV, V(2) 0.5 kV, V(3)=0.7 kV, V(4)=1.1 kV, and V(5)=2 kV. The frequency of the first period is 10 kHz, the frequency of the second period is 2 kHz, and the maximum Vpp is 2 kV, which is the same as the first embodiment.

Compared to the waveform of the first embodiment, although it is the same in terms of that the maximum Vpp is applied and thereafter the initial Vpp is applied, in this embodiment, since the Vpp applied subsequently is smaller than that of the first embodiment, the toner that has been toward the photoreceptor 51 is likely to reach a dot latent image, thus the dot reproducibility is further improved. Actually compared to the result of Example 1, the dot reproducibility is improved by 10%.

Next, a third embodiment of the invention will be described. In this embodiment, the waveform of the development bias voltage is different from those of the first and second embodiments.

Figure 13:
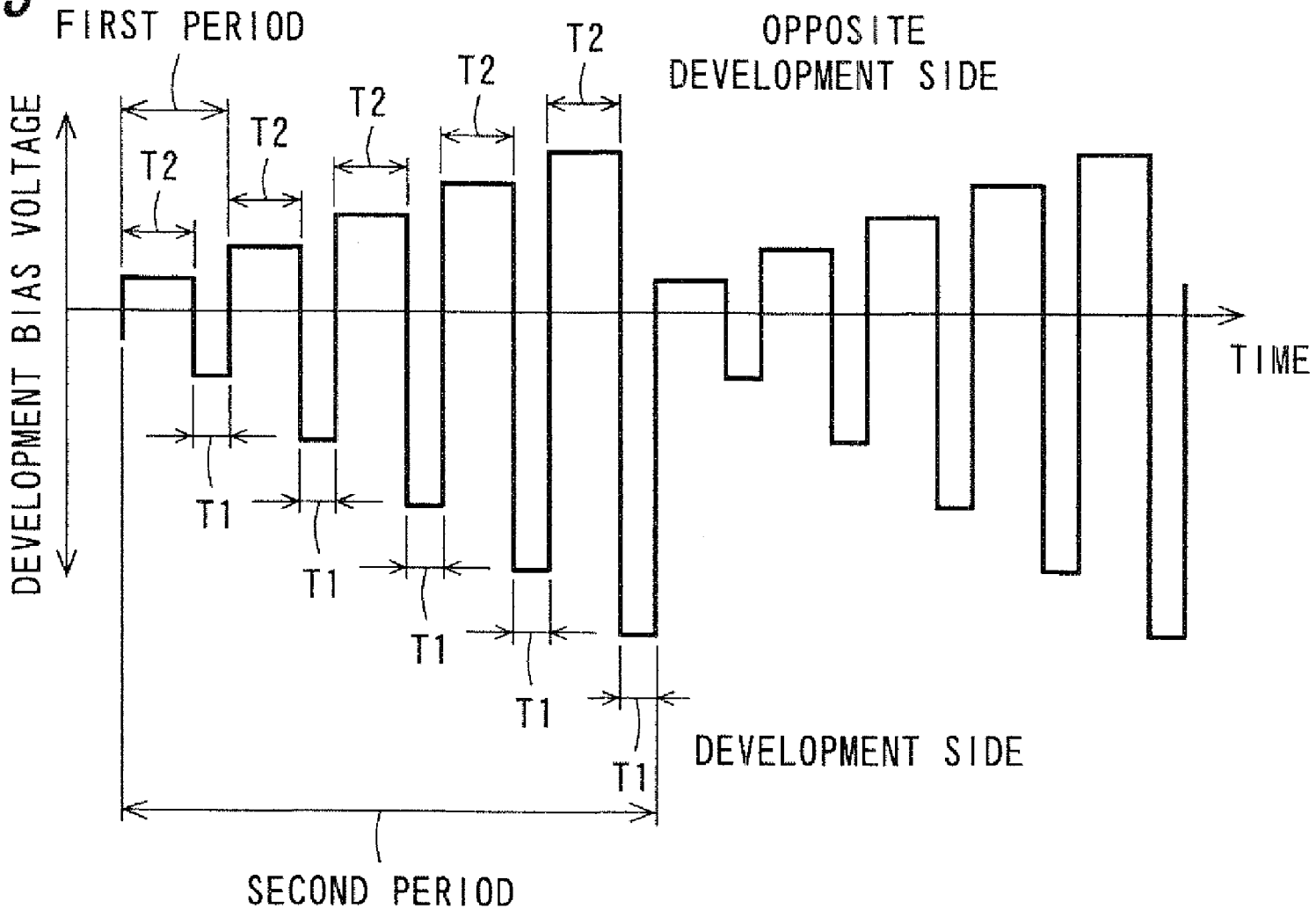
FIG. 13 is a view showing the waveform of the development bias voltage in a third embodiment.

FIG. 13 is a view showing the waveform of the development bias voltage in the third embodiment.

Although it is the same in terms of that the Vpp is gradually increased from the initial Vpp to the maximum Vpp, it is different from the first and second embodiments in terms of that the time for applying the development-side electrical potential in the direction of moving toner from the developing roller 3 to the photoreceptor 51 is made shorter than the time for applying the opposite development-side electrical potential in the direction of moving toner from the photoreceptor 51 to the developing roller 3.

By making the time for applying the development-side electrical potential shorter than the time for applying the opposite development-side electrical potential, it is possible to increase the force of moving toner from the developing roller 3 to the photoreceptor 51 and reduce the force of returning toner from the photoreceptor 51 to the developing roller 3. Whereby, it is possible that while keeping the development amount of the toner to the photoreceptor 51, the returning amount of the toner to the developing roller 3 is reduced to thereby enhance the dot reproducibility.

In the first period, the time for applying the development-side electrical potential is T1, the time for applying the opposite development-side electrical potential is T2, and duty ratio is T1/(T1+T2).

In the waveform of the bias voltage shown in FIG. 13, the frequency of the second period is 2 kHz, the frequency of the first period is 10 kHz, the initial Vpp is 0.4 kV, the maximum Vpp is 2 kV, and the duty ratio is 0.35. In the waveform of the bias voltage shown in FIG. 12, an average voltage of the first period is constant.

In order to find a preferable value of the duty ratio, the characteristic when the duty ratio is changed was evaluated. FIG. 14 is a view showing evaluation results of image density and dot reproducibility when the duty ratio is changed.

When the duty ratio was reduced, the dot reproducibility was improved. This is influenced by that the opposite development-side electrical potential becomes small and the toner is not likely to return to the developing roller 3, and although the time for applying the opposite development-side electrical potential is made long, the dot reproducibility tends to be enhanced. This shows that the value of the applied voltage has much more effect on the dot reproducibility than the application time of the bias voltage under such a condition.

The image density was likely to be reduced when the duty ratio was large and small. In a case where the duty ratio is lower than 0.25, for example, even when the frequency of the first period is 10 kHz, the time for applying the development-side electrical potential is made shorter, thus follow-up of the toner is made difficult. Accordingly, it is considered that the image density is reduced. However, when the duty ratio is 0.35, the time for applying the development-side electrical potential is made shorter, which is compensated by the effect of improving the utilization efficiency of the toner due to increased development-side electrical potential, thus the image density is not reduced. On the other hand, when the duty ratio is increased, the development-side electrical potential becomes small to reduce the image density.

As a result, the usable range of the duty ratio is 0.25 or more and 0.50 or less, and more preferably, 0.35 or more and 0.45 or less.

Next, a fourth embodiment of the invention will be described. In this embodiment, the waveform of the development bias voltage is different from those of the first to third embodiments.

Figure 15:
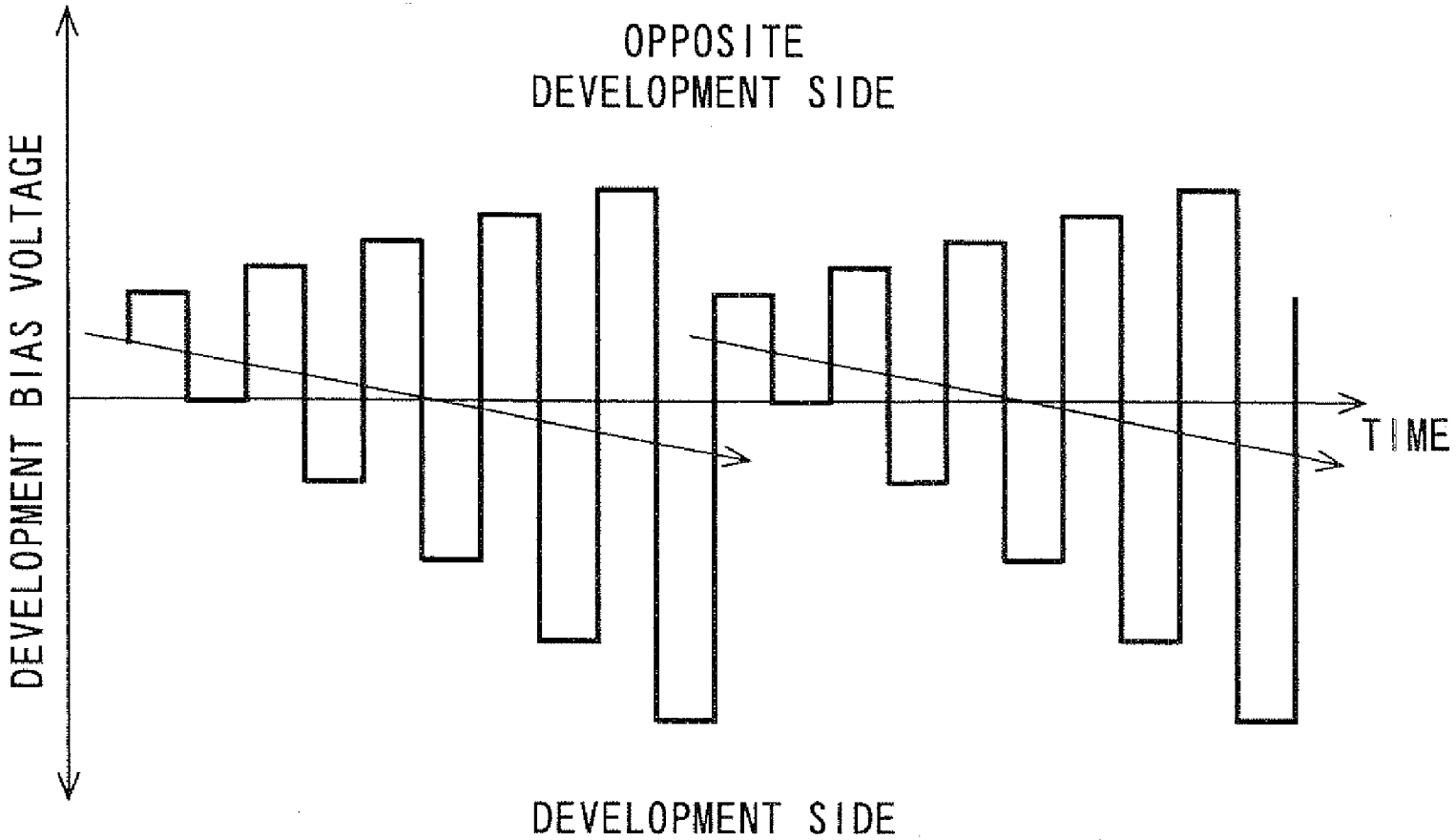
FIG. 15 is a view showing the waveform of the development bias voltage in a fourth embodiment.

FIG. 15 is a view showing the waveform of the development bias voltage in the fourth embodiment.

Although it is the same in terms of the fact that the Vpp is gradually increased from the initial Vpp to the maximum Vpp, it is different in terms of the fact that the center potential is shifted. In the waveform of the development bias voltage as shown in FIG. 15, gradual shift is made to the development-side electrical potential in which the toner is moved from the developing roller 3 to the photoreceptor 51. However, since an average potential for every second period is kept constant, shift to the opposite development-side electrical potential is made in a region where the Vpp is small.

For example, in the waveform of Example 1, where V(1)=0.4 kV, V(2)=0.8 kV, V(3)=1.2 kV, V(4)=1.6 kV, V(5)=2 kV, and the duty ratio was 50%, each direct current voltage of the minimum Vpp and the maximum Vpp was shifted in the opposite direction by 50 Vr respectively. The direct current voltage of the development bias voltage during that time was set on a straight line connecting both shift amounts by a straight line. By setting as such and comparing the case where the waveform is the same as Example 1 and the direct current voltage is 300 V to the case of this embodiment, the image density was 1.4 in Example 1, while the image density was increased by 0.15 to be 1.55 in this embodiment.

In the case of this embodiment, since the development-side electrical potential is increased by 50 V in a region where the Vpp is large, the toner is likely to be developed and the density is high. On the other hand, the opposite development-side electrical potential becomes large in a region where the Vpp is small, the dot reproducibility tends to be reduced slightly.

Accordingly, like this embodiment, the setting in which shift to the opposite development-side electrical potential is made in a region where the Vpp is small is suitable for the case where the image density is given priority over the dot reproducibility.

To the contrary, in the setting in which shift to the development-side electrical potential is made in a region where the Vpp is small, the image density is slightly reduced but the dot reproducibility is improved. Accordingly, depending on giving priority to the image density or giving priority to the dot reproducibility, shifting to which potential may be selected.

Next, a fifth embodiment of the invention will be described. This embodiment has the structure in which the development bias voltage used in the first to fourth embodiments and the conventional development bias voltage shown in FIG. 4 are selectively used as appropriate.

Usually, when the charge amount of toner is changed due to environmental change, deterioration in the carrier, or the like, and the image density is changed, it is general to adjust the direct current voltage of the development bias voltage to keep the image density constant.

Specifically, a test patch image for detecting the image density is formed on the photoreceptor and the image density of the test patch is detected. Comparing the detection result to a predetermined standard image density, the direct current voltage of the development bias voltage is decided so as to be matched to the standard image density, depending on the comparison result.

There is also an image forming apparatus in which, in order to form a color image, an intermediate transfer medium is provided, and toner images in the respective colors formed on the photoreceptor are temporarily transferred and overlaid onto the intermediate transfer medium sequentially, which is transferred again to a sheet at once.

In the image forming apparatus having such a configuration, the test patch image formed on the photoreceptor for detecting the image density is transferred on the intermediate transfer medium in contact with the photoreceptor and the image density of an image that is formed by reading reflection light therefrom is detected. Depending on the detection result of the image density, by controlling the direct current voltage of the development bias voltage so as to be the standard image density, image quality is compensated.

Accordingly, it is possible to detect the density close to the state of being formed on the sheet actually with a toner image naturally formed on the photoreceptor transferred, thus making it possible to compensate image quality more excellently. In other words, the test patch image having a predetermine tone that is formed on the photoreceptor is transferred to a transfer drum or the like, the image density of the transferred toner image is detected, whether or not the detected density is a reference density is determined, and depending on the determination result, the direct current voltage of the development bias voltage is controlled to be the reference density.

Since the image density becomes high when the charge amount of the toner is small, even in the case of the waveform in which the Vpp is not changed like in Comparative example shown in FIG. 4, when the Vpp is small, for example, when the Vpp is 0.8 kV, sufficient image density is obtained. In addition, it is possible to adjust the density by the direct current component of the development bias voltage.

However, when the charge amount of the toner is increased due to a low-humidity condition, the image density is decreased when the direct current voltage is constant. Against this, decrease of the density to some degree is capable of being adjusted by increasing the direct current component of the development bias voltage, but when the direct current voltage of the development bias voltage is increased, the surface potential of the photoreceptor 51 is also increased. Accordingly, the upper limit for the direct current voltage of the development bias voltage is restricted by the upper limit for the surface potential of the photoreceptor 51, and after reaching the upper limit value of the development bias voltage, it is impossible to adjust the image density.

In such a case, as described above, it is also possible to use the development bias voltage waveform of the invention only when the shortage of the image density is adjusted.

In other words, in the above-described embodiments, the structure in which development is performed using the same development bias voltage waveform at all times has been described, but for example, under the specific condition where the development bias voltage waveform in which the Vpp is not changed as shown in FIG. 4 is used and the image density is not capable of being adjusted by the direct current voltage due to increased charge amount of the toner, the structure may be provided so as to switch to the development bias voltage waveform in which the Vpp is gradually increased from the initial Vpp to the maximum Vpp. This structure makes it possible to prevent the shortage of the image density.

Only to increase the image density simply, the development bias voltage waveform in which the Vpp is increased, which has been described above, may be used at all times without switching the development bias voltage, but in such a case, when the charge amount of the toner is reduced due to environmental change, deterioration in the carrier, or the like, the image density is likely to become very dense. In order to avoid this, it is necessary to reduce the direct current voltage, but it is difficult to adjust the density when the direct current voltage is very low.

Accordingly, when developer in which the charge amount of the toner is likely to change due to environmental change, deterioration in the carrier, or the like, is used, the structure in which the development bias voltage waveform is switched as appropriate is effective. The switching of the development bias voltage waveform is performed by a CPU for control (not shown). The structure may be provided so that a plurality of development bias voltage waveforms and switching conditions of waveforms (such as environmental condition, charge amount of toner and image density) are stored in a predetermined storage area, and depending on the switching conditions, an appropriate development bias voltage waveform is used.

Figure 16:
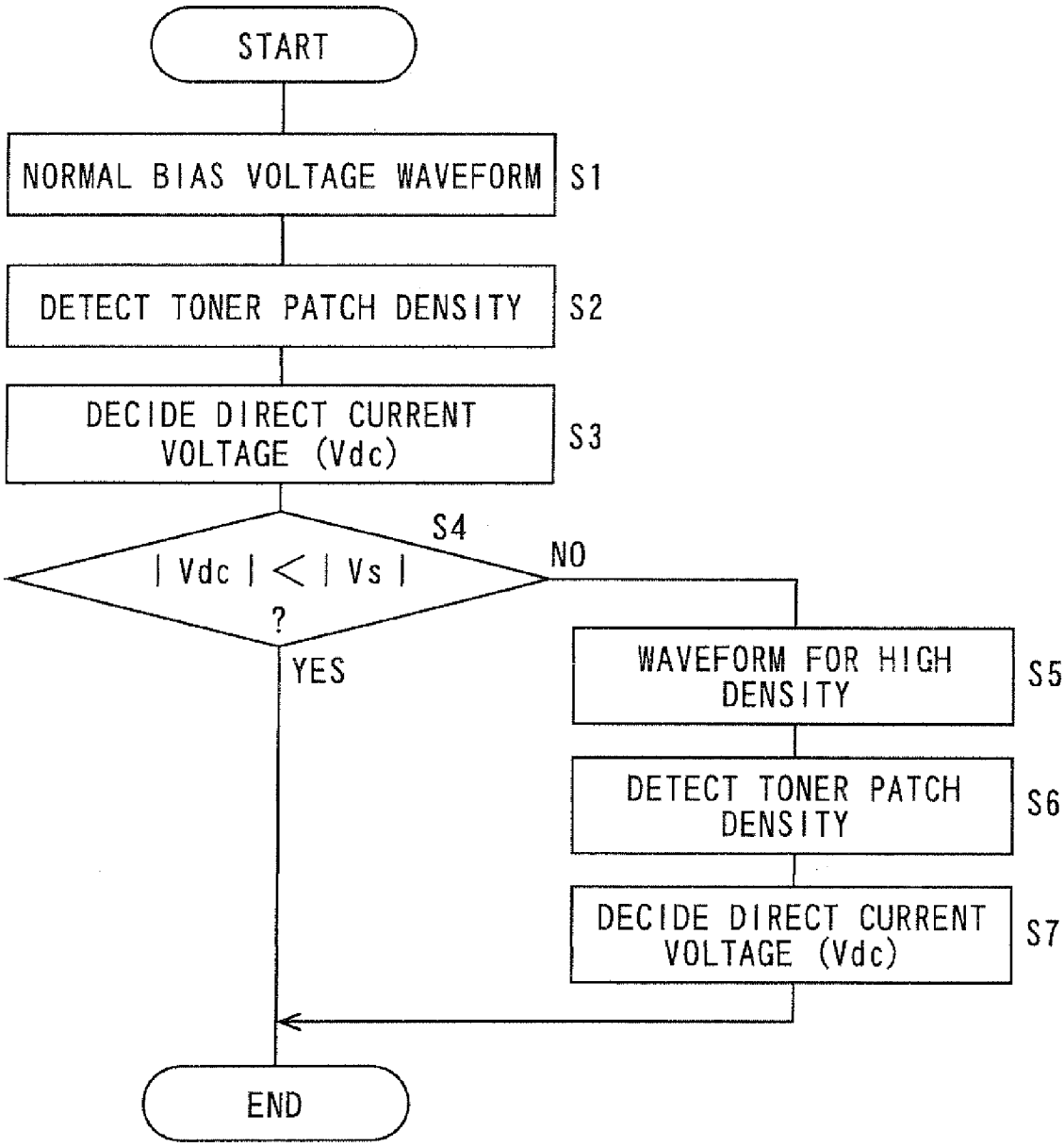
FIG. 16 is a flowchart showing a development bias voltage switching control of a fifth embodiment.

FIG. 16 is a flowchart showing a development bias voltage switching control of the fifth embodiment.

At step S1, development is performed with the normal development bias voltage waveform, that is, the development bias voltage waveform in which the Vpp is not changed, and at step S2, a test patch image for detecting the image density is formed on the photoreceptor and the image density of the test patch image is detected. At step S3, the detection result for the test patch image is compared to a predetermined standard image density, and depending on the comparison result, the direct current voltage Vdc of the development bias voltage is decided so as to be matched to the standard image density.

At step S4, the decided direct current voltage Vdc is compared to the reference voltage Vs as a reference to determine switching of the bias voltage waveform, and when the Vdc (absolute value) is lower than Vs (absolute value), it is possible to adjust the image density and the development is continued without switching the development bias voltage waveform.

When Vdc (absolute value) is larger than Vs (absolute value), it is impossible to adjust the image density by the direct current voltage, and the procedure proceeds to step S5 and the development bias voltage waveform is switched to the bias voltage waveform for high density adjustment, that is, to the development bias voltage waveform in which the Vpp is gradually increased from the initial Vpp to the maximum Vpp, which is characteristic of the invention. At step S6, the image density of the test patch image is detected again, and at step S7, the direct current voltage Vdc of the development bias voltage is decided so as to be matched to the standard image density.

Note that, although two-component development has been described in the above, the invention is not limited to the two-component development as far as having the structure in which toner is developed by the development bias voltage, and similar effect is also obtained in single-component development.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing device that develops an electrostatic latent image formed on an electrostatic latent image bearing member with toner by applying an alternating voltage superimposed on a direct current voltage to a developer bearing member, wherein the alternating voltage to be applied has an alternating voltage waveform in which a development-side electrical potential to move toner from the developer bearing member to the electrostatic latent image bearing member and an opposite development-side electrical potential to move toner from the electrostatic latent image bearing member to the developer bearing member are applied so as to alternate with each other, and wherein the alternating voltage waveform has a repeating predetermined pattern, the predetermined pattern including a first time period during which each of the development-side electrical potential and the opposite development-side electrical potential is applied once at an initial minimum value, wherein a peak-to-peak voltage of the alternating waveform is gradually increased from the initial minimum value to a maximum value during a second time period, the second time being longer than the first time period and including the first time period, and wherein the predetermined pattern is then repeated, with the electrical potential of the waveform reducing back down to the initial minimum peak-to-peak voltage and then gradually increasing again to the maximum value.

2. The developing device of claim 1, wherein the second time period includes n pieces of first time periods, and when respective peak-to-peak voltages from the initial minimum peak-to-peak voltage to the maximum peak-to-peak voltage are changed into V(1), V(2), . . . , V(n), with elapse of time, the respective peak-to-peak voltage satisfies the following formula (1):

$$V(i) \leqq V(i+1)$$

$$V(1) < V(n) \quad (1)$$

(wherein, $1 \leqq i \leqq n-1$ (i is an integer number)).

3. The developing device of claim 1, wherein the second time period includes n pieces of first time periods, and when respective peak-to-peak voltages from the initial minimum peak-to-peak voltage to the maximum peak-to-peak voltage are changed into V(1), V(2), . . . , V(n), with elapse of time, the respective peak-to-peak voltages satisfy the following formula (2):

$$V(i+1)-V(i) \leqq V(i+2)-V(i+1) \quad (2)$$

(wherein, $1 \leqq i \leqq n-2$ (i is an integer number)).

4. The developing device of claim 1, wherein the alternating voltage is applied so that the peak-to-peak voltage that is applied lastly in the second period becomes the development-side electrical potential.

5. The developing device of claim 1, wherein the alternating voltage is applied so as to satisfy a condition of $T2 \geqq T1$ in the first period, wherein a time for applying the development-side electrical potential is T1 and a time for applying the opposite development-side electrical potential is T2.

6. The developing device of claim 1, wherein the alternating voltage is applied so as to satisfy a condition of $0.25 \leqq T1/(T1+T2) \leqq 0.50$ in the first period, wherein a time for applying the development-side electrical potential is T1 and a time for applying the opposite development-side electrical potential is T2.

7. The developing device of claim 1, wherein the alternating voltage is applied so as to satisfy a condition of $0.35 \leqq T1/(T1+T2) \leqq 0.45$ in the first period, wherein a time for applying the development-side electrical potential is T1 and a time for applying the opposite development-side electrical potential is T2.

8. The developing device of claim 1, wherein in the alternating voltage, a frequency of the first period is 5 kHz or more and 25 kHz or less.

9. The developing device of claim 1, wherein in the alternating voltage, a frequency of the first period is 8 kHz or more and 20 kHz or less.

10. The developing device of claim 1, wherein in the alternating voltage, a periodic number of the first period included in the second period is 4 or more and 15 or less.

11. The developing device of claim 1, wherein in the alternating voltage, a frequency of the second period is 1 kHz or more and 6.3 kHz or less.

12. The developing device of claim 1, wherein in the alternating voltage, a center voltage for every first period is linearly shifted to the development side or the opposite development side.

13. An image forming apparatus comprising at least an image bearing member, a detecting section for detecting a density of a reference toner image formed on a surface of the image bearing member, a process control section for adjusting an image density by correcting a setting value of a direct current voltage applied to a developer bearing member in accordance with the density of the reference toner image detected by the detecting section, and the developing device of claim 1, wherein switching can be carried out between a normal alternating voltage waveform that applies a constant peak-to-peak voltage and an alternate alternating voltage waveform that does not apply a constant peak-to-peak voltage, and while applying the normal alternating voltage waveform, when the direct current voltage reaches a predetermined voltage or more, switching to the alternate alternating voltage waveform is carried out.

14. The image forming apparatus of claim 13, wherein the developer is two-component developer including toner and carrier.

* * * * *